US005132594A

United States Patent [19]

Nilssen

[11] Patent Number: 5,132,594

[45] Date of Patent: Jul. 21, 1992

[54] LONGER-LIFE INCANDESCENT LAMP

[76] Inventor: Ole K. Nilssen, Caesar Dr., Barrington, Ill. 60010

[21] Appl. No.: 600,249

[22] Filed: Oct. 22, 1990

Related U.S. Application Data

[63] Continuation of Ser. No. 195,798, May 19, 1988, abandoned.

[51] Int. Cl.[5] ..... H05B 39/10

[52] U.S. Cl. ..... 315/88; 315/65; 315/120; 315/312; 362/212

[58] Field of Search ..... 315/65, 88, 93, 120, 315/129, 68, 73, 74, 64, 89, 90, 312, 313; 362/211, 212, 240, 254, 234, 251, 252, 227, 363

[56] References Cited

U.S. PATENT DOCUMENTS

| | | | |
|---|---|---|---|
| 1,758,434 | 5/1930 | Castro | 315/65 |
| 1,802,838 | 4/1931 | Sakakura | 315/66 |
| 1,838,372 | 12/1931 | Castro | 315/65 |
| 1,925,200 | 9/1933 | Miller | 315/93 |
| 1,946,570 | 2/1934 | Beidler | 315/65 X |
| 2,056,806 | 10/1936 | Reno | 315/93 X |
| 2,278,837 | 4/1942 | Castro | 315/65 |
| 2,605,446 | 7/1952 | Cartun | 315/120 |
| 3,382,403 | 5/1968 | Lloyd | 315/65 |
| 3,435,286 | 3/1969 | Kayatt | 362/212 X |
| 3,968,395 | 7/1976 | Obermaier | 315/93 |
| 4,161,021 | 7/1979 | George, Jr. | 362/240 X |
| 4,498,124 | 2/1985 | Mayer et al. | 362/211 |

*Primary Examiner*—Eugene R. LaRoche
*Assistant Examiner*—Amir Zarabian

[57] ABSTRACT

An incandescent lamp has a first and a second filament, one or the other of which is arranged to connect with the socket voltage in an ordinary lamp socket by way of a bistable thermally actuated switch built into the lamp. Upon initial provision of the socket voltage, the first filament is arranged to connect with the socket voltage and to so remain connected except if the thermal switch were to actuate. Provided the second filament is intact, the thermal switch will indeed actuate after but a few seconds; whereafter this second filament gets connected with the socket voltage, so to remain connected until the socket voltage is removed or until this second filament fails. After the second filament has indeed failed, the thermal switch will not get actuated and the socket voltage will not switch away from the first filament. The initial action of the thermal switch is effectuated by a small amount of heat applied to the thermal switch by a heating resistor powered from the socket voltage by way of the second filament. After the thermal switch actuates, it will remain in its actuated state due to heat supplied to it by the second filament.

9 Claims, 1 Drawing Sheet

LONGER-LIFE INCANDESCENT LAMP

This is a continuation of application Ser. No. 07/195,798 filed May 19, 1988, now abandoned.

BACKGROUND OF THE INVENTION

1. Field of the Invention

The present invention relates to incandescent lamps, particularly of a type exhibiting longer-than-normal life expectancy.

2. Description of Prior Art

A common approach to attaining increased life expectancy of an incandescent lamp is that of reducing the amount of power supplied to its filament; which implies a reduction in the filament's operating temperature. However, reducing the filament's operating temperature results in decreased luminous efficacy; which under most circumstances is undesirable. One approach to attaining increased lamp life by reduction of filament temperature is described in U.S. Pat. No. 4,229,680 to Nilssen.

Another approach is that of enclosing the filament within an envelope operative to permit relatively easy transmission of photons of visible frequencies, while reflecting back onto the filament photons of infrared frequencies. That way, some of the heat-generating energy may be conserved, thereby making the overall production of vidible light more efficient. An improved-efficacy incandescent lamp based on this approach is described in U.S. Pat. No. 4,612,473 to Nilssen.

GENERAL PURPOSE OF PRESENT INVENTION

The general purpose of the present invention is that of providing for an approach to increasing the life expectancy of an incandescent lamp without suffering a concomitant reduction in luminous efficacy.

SUMMARY OF THE INVENTION

OBJECTS OF THE INVENTION

An object of the present invention is that of providing for means by which to attain substantially increased life expectancy of an incandescent lamp without incurring a comcominant reduction in luminous efficacy.

This as well as other objects, features and advantages of the present invention will become apparent from the following description and claims.

BRIEF DESCRIPTION

In its preferred embodiment, the invention is represented by an incandescent lamp having a first and a second filament, one or the other of which is arranged to connect with the socket voltage in an ordinary lamp socket by way of a bistable thermally actuated switch built into the lamp. Upon initial provision of the socket voltage, the first filament is arranged to connect with the socket voltage and to so remain connected except if the thermal switch were to actuate. Provided the second filament is intact, the thermal switch will indeed actuate after but a few seconds; whereafter this second filament gets connected with the socket voltage, so to remain connected until the socket voltage is removed or until this second filament fails. After the second filament has indeed failed, the thermal switch will not get actuated and the socket voltage will not switch away from the first filament.

The initial action of the thermal switch is effectuated by a small amount of heat applied to the thermal switch by a heating resistor powered from the socket voltage by way of the second filament. After the thermal switch actuates, it will remain in its actuated state due to heat supplied to it by the second filament.

Thus, in overall net effect, the incandescent lamp of the present invention will exhibit twice the life expectancy of an incandescent lamp having but a single filament; yet will have suffered no degradation in luminous efficacy. As long as both filaments are intact, the switch-over from the first filament to the second filament will occur essentially without being visually discernable under normal circumstances. Of course, the second filament will normally be the first one to burn out; and thereafter, no switch-over will occur.

DESCRIPTION OF THE PREFERRED EMBODIMENT

DETAILS OF CONSTRUCTION

Figure 1:
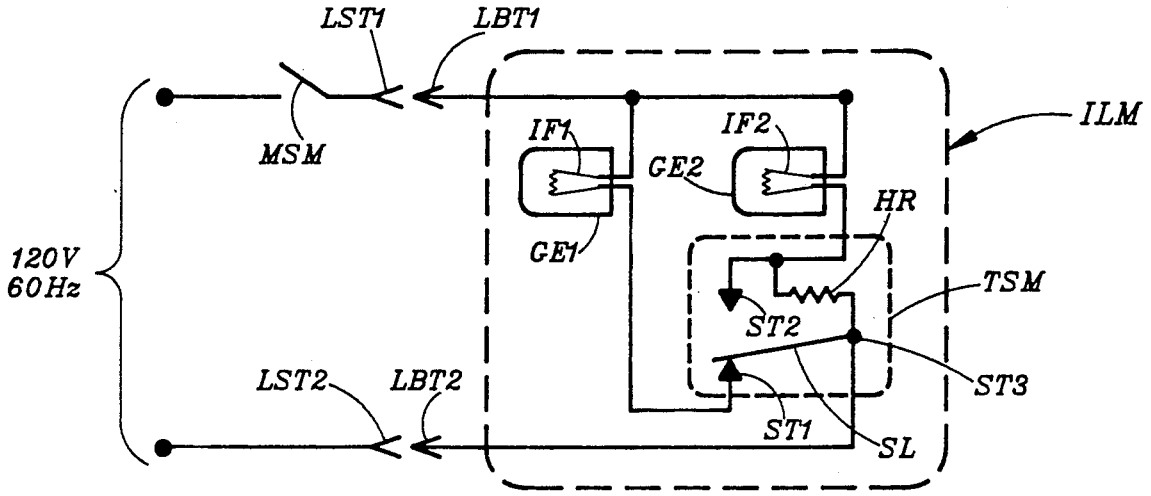
FIG. 1 diagrammatically illustrates the basic circuit arrangement of the invention in its preferred embodiment.

FIG. 1 schematically illustrates the basic electrical circuit arrangement of the preferred embodiment of the invention.

In FIG. 1, 120 Volt/60 Hz power line voltage from an ordinary electric utility power line is provided to lamp socket terminals LST1 and LST2 by way of a manual switch means MSM.

Incandescent lamp means ILM is disconnectably connected with lamp socket terminals LST1 and LST2 by way of lamp base terminals LBT1 and LBT2, respectively.

A first incandescent filament IF1 inside a glass envelope GE1 is connected between lamp base terminal LBT1 and a first switch terminal ST1 of thermal switch means TSM. A second incandescent filament IF2 inside a glass envelope GE2 is connected between lamp base terminal LBT1 and a second switch terminal ST2 of thermal switch means TSM. A third switch terminal ST3 is connected with lamp base terminal LBT2. A heating resistor HR is connected between switch terminals ST2 and ST3. A thermally sensitive switch lever SL is at its one end permanently connected with switch terminal ST3 and at its other end, depending upon its temperature, connected either with switch terminal ST1 (as shown, when relatively cold) or with switch terminal ST2 (when relatively warm).

Figure 2:
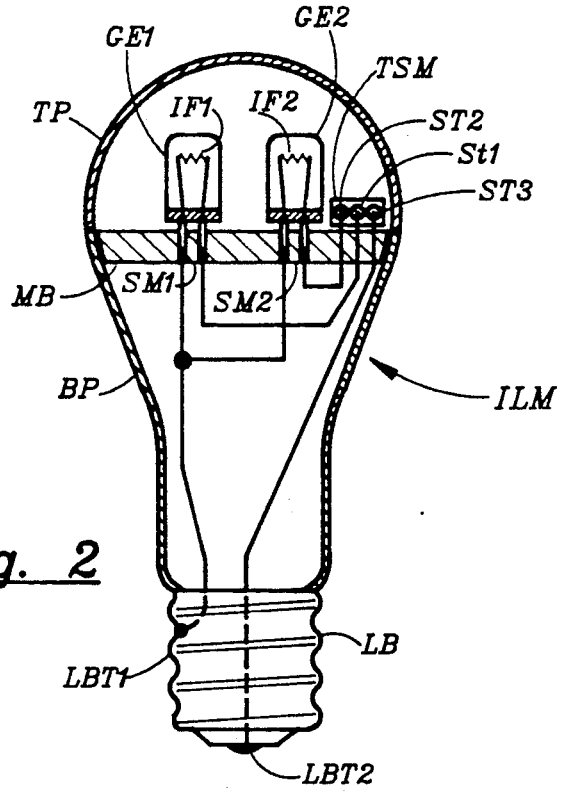
FIG. 2 illustrates an incandescent lamp made in accordance with the invention.

FIG. 2 illustrates the incandescent lamp means ILM constructed in accordance with the electrical diagram of FIG. 1.

In FIG. 2 the first and the second incandescent filaments IF1 and IF2 in their glass envelopes GE1 and GE2 are removably mounted in socket means SM1 and SM2 in a mounting base MB fastened to the lower part of the incandescent lamp means, which lower part is referred-to as a base part BP and has a regular screw-in lamp base LB. The thermal switch means TSM is located in near proximity to the second glass envelope GE2, thereby to receive heat produced by the second incandescent filament IF2. A top part TP is removably fastened to the base part BP.

DETAILS OF OPERATION

Incandescent lamp means ILM of FIGS. 1 and 2 operates such that when 120 Volt/60 Hz socket voltage is initially applied to lamp base terminals LBT1 and LBT2, as for instance by closing manual switch means MSM, the 120 Volt/60 Hz voltage gets applied directly across the IF1 filament, which filament then immediately gets incandescent, thereby immediately to provide illumination from incandescent lamp means ILM.

However, the 120 Volt/60 Hz voltage also gets applied across the series-combination of the IF2 filament and heating resistor HR; which, due to the fact that the resistance of heating resistor HR is very much larger than that of the IF2 filament, means (as long as the IF2 filament is intact) that the 120 Volt/60 Hz voltage in effect gets applied across heating resistor HR; which then, in turn, applies a modest amount of heat directly to the switch lever.

After having been powered with the 120 Volt/60 Hz for a few seconds, the heat generated by heating resistor HR is enough to cause thermally actuated switch lever SL to snap into its other position, thereby to remove the 120 Volt/60 Hz voltage from the IF1 filament; connecting instead the 120 Volt/60 Hz voltage directly across the IF2 filament.

In so doing, the 120 Volt/60 Hz voltage across heating resistor HR is also removed. However, since thermal switch means TSM is located relatively close to the IF2 filament, heat from that filament will operate to maintain the switch lever in its actuated state.

Thus, with both incandescent filaments intact, incandescent lamp means ILM will operate in the following manner. During the initial few seconds, the 120 Volt/60 Hz voltage will be applied to the IF1 filament, which will then provide luminous output. Thereafter, the 120 Volt/60 Hz voltage will automatically and rapidly reconnect to the IF2 filament, which then will provide luminous output as well as enough heat to maintain thermal switch means TSM in its actuated state.

However, if the IF2 filament were to burn out, the thermal switch means would lose its source of heat and therefore revert to its non-activated state, thereby connecting the 120 Volt/60 Hz socket voltage across the IF1 filament; which thereafter would provide the luminous output. However, since thermal switch means TSM is located relatively far away from the IF1 filament, the heat provided by this IF1 filament is inadequate to cause switch actuation, thereby preventing unstable circuit operation.

Thus, with only the IF1 filament intact, the 120 Volt/60 Hz socket voltage would be applied to the IF1 filament and would remain so applied since there would be no power provided to heating resistor HR, which means that not enough heat would be supplied to thermal switch means TSM to cause it to actuate.

As may be perceived directly by inspection of FIG. 2, the shape and size of incandescent lighting means ILM is substantially the same that an ordinary Edison-type light bulb, such as a so-called A-19 or A-21 light bulb with a so-called Medium Base. For information with respect to the meaning of the terms A-19, a-21 and Medium Base, reference is made to pages 12–13 of General Electric Lamp Catalog, Form 9200, 1979 Edition.

ADDITIONAL COMMENTS (a) The top portion (TP) of incandescent lamp means ILM is removably and replaceably fastened to the bottom part BP by simple press fit. If desired, such as for changing one or both of the filament-containing glass envelopes GE1/GE2 (which in reality are Halogen-type lamp units), the top portion may be snapped off, and then replaced by simple press action.

(b) The Halogen-type lamp units are of such nature as not to blacken during their life; which is important in order not to cause deterioration of the effective light output from the IF1 filament after the IF2 filament has burned out.

(c) The arrangement herein described may be extrapolated to contain three or more incandescent filaments, thereby permitting an even higher increase in effective lamp life expectancy.

(d) The arrangement described herein may also be used in a more-or-less ordinary throw-away incandescent lamp, in which case there would be need for separate glass envelopes for the two incandescent filaments.

(e) Instead of being maintained in an actuated state by heat provided from the IF2 filament, thermal switch means TSM may be maintained in its actuated state by way of a small heating resistor connected in series with the IF2 filament. That way, the location of thermal switch means TSM is far less critical. In fact, it may then actually be located in the lamp socket; which, of course, would then have to be a three-way-type of lamp socket.

(f) As long as both filaments are intact, during the start-up period of the incandescent lamp means (ILM), when the socket voltage is switched from the IL2 filament to the IL1 filament, the transition is of such nature as to be barely discernable in terms of the net total amount of light provided by the the incandescent lamp means. This is achieved by making the thermal switch means a device with so-called snap action.

(g) The location of the thermal switch means (TSM) with respect to the two filaments provides for an easily discernable indication to the effect of informing an observer with respect to whether or not both filaments are intact. With socket voltage having been provided to the incandescent lamp means (ILM) for more than a few seconds i) if the filament closer to the thermal switch means is incandescent, both filaments are intact; ii) if the filament further removed from the thermal switch means is incandescent, the other filament is burned out; and iii) if neither filament is incandescent, they are both burned out.

In other words, by observing which one of the two filaments is incandescent—using the thermal switch means is a basis of reference—information is obtained with respect to whether or not it is time to replace one of the filaments. Thus, by replacing the burned-out filament before the other filament burns out, it becomes possible to provide for complete continuity of service from the incandescent lamp means.

(h) It is anticipated that in some situations it might be desirable to have the two filaments different. For instance, the IF2 filament light be arranged to provided less light than the IF1 filament, thereby to provide even more cleary discernable indication to the effect that it is time to replace one of the filaments.

i) It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. An arrangement comprising:

voltage source having source terminals at which is provided a source voltage;

first lamp means having a first pair of lamp terminals between which a first lamp current may flow thereby to provide a first amount of light;

second lamp means having a second pair of lamp terminals between which a second lamp current may flow, thereby to provide a second amount of light; the second amount of light being about equal to the first amount of light; and switch means connected in circuit between the source terminals and the lamp terminals; the switch means being operative:

(a) whenever the first lamp means is in the state of being operational; (i) to initially cause the first pair of lamp terminals to be connected with the source terminals, thereby to cause said first lamp current to flow; and (ii) after the first lamp current has been flowing for a brief period, to cause the second lamp terminals to be connected with the source terminals, thereby to cause the first lamp current to cease flowing and the second lamp current to start flowing; and (b) whenever the second lamp means is not in the state of being operational, to cause the first lamp means to remain connected with the source terminals;

the arrangement being so constituted that, as long as both lamp means are in the state of being operational, the source voltage is never provided across the first pair of lamp terminals at the same time as it is provided across the second pair of lamp terminals.

2. The arrangement of claim 1 wherein the first and second lamp means and the switch means are combined into an integral entity having no detachable parts.

3. The arrangement of claim 1 wherein: (i) the source terminals are the socket terminals of an ordinary incandescent lamp socket; (ii) the first and second lamp means as well as the switch means are mounted on a lamp base inserted into the lamp socket; (iii) the lamp base has base terminals; and (iv) the base terminals are connected in circuit with the lamp terminals and the switch means.

4. The arrangement of claim 1 further characterized by constituting a substantially rigid entity and being contained within a surface having the shape substantially equal to the shape of the outer surface of an ordinary Edison-type screw-in incandescent light bulb.

5. The arrangement of claim 1 wherein the voltage source is an ordinary electric utility power line.

6. The arrangement of claim 1 wherein the first lamp means, when being powered, is functional to generate substantially the same amount of light as does the second lamp means when it is being powered.

7. The arrangement of claim 1 wherein the switch means is characterized by including a thermally actuatable contactor means.

8. An arrangement, comprising:

source means having a Va terminal and a Vb terminal and being conditionally operable to provide a voltage therebetween;

first lighting means having a L1a terminal and a L1b terminal;

second lighting means having a L2a terminal and a L2b terminal;

thermally actuatable switch means having an Sx terminal, an Sy terminal, and an Sz terminal; the switch means being operable in response to heat to exist in either of two states; a first state wherein the Sx terminal is connected with the Sy terminal; and a second state wherein the Sx terminal is connected with the Sz terminal;

the Va terminal being connected with the L1a and the L2a terminals; the Vb terminal being connected with the Sx terminal; the L1b terminal being connected with the Sy terminal; and the L2b terminal being connected with the Sz terminal;

the switch means being operable: (i) provided the second lighting means is properly operable, to cause the Sx terminal to be connected with the Sz terminal, thereby to provide the voltage between the L2a and the L2b terminals; and (ii) provided the second lighting means is not properly operable, to cause the Sx terminal to be connected with the Sy terminal, thereby without interruption to provide the voltage to the L1a and L1b terminals.

9. A special light bulb adapted to be screwed into and to be held by an ordinary Edison-type lamp socket; the special light bulb being characterized by comprising:

a screw-base having base terminals;

an envelope mounted on the screw-base; at least part of the envelope being translucent; the envelope having an outer surface substantially equal to that of an ordinary electric light bulb of the type most commonly used in an ordinary Edison-type lamp socket, such as a so-called A-21 light bulb;

a first and a second light-producing means; each light-producing means having a pair of power input terminals and being: (i) operable, when not damaged, to produce light when supplied with ordinary power line voltage; and (ii) prone to become damaged; and control means connected in circuit between the base terminals and the two pairs of power input terminals; the control means being operable; (i) to connect the power input terminals of the first light-producing means directly with the base terminals; thereby to cause it to produce light on a substantially continuous basis as long as ordinary power line voltage is being supplied to the base terminals; and (ii) in case the first light-producing means were to have become damaged, to connect the power input terminals of the second light-producing means directly with the base terminals, thereby to cause it to produce light on a substantially continuous basis as long as ordinary power line voltage is being supplied to the base terminals; the two pairs of power input terminals never being directly connected with the base terminals at the same time.

* * * * *